US010114322B2

(12) United States Patent
Hasegawa et al.

(10) Patent No.: US 10,114,322 B2
(45) Date of Patent: Oct. 30, 2018

(54) FIXING DEVICE AND IMAGE FORMING APPARATUS

(71) Applicants: Kenichi Hasegawa, Kanagawa (JP); Takashi Fujita, Kanagawa (JP); Hiroyuki Shimada, Tokyo (JP); Kaori Hemmi, Kanagawa (JP)

(72) Inventors: Kenichi Hasegawa, Kanagawa (JP); Takashi Fujita, Kanagawa (JP); Hiroyuki Shimada, Tokyo (JP); Kaori Hemmi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/657,417

(22) Filed: Jul. 24, 2017

(65) Prior Publication Data

US 2018/0059598 A1 Mar. 1, 2018

(30) Foreign Application Priority Data

Aug. 26, 2016 (JP) ..... 2016-165718
Oct. 14, 2016 (JP) ..... 2016-202869

(51) Int. Cl.
*G03G 15/20* (2006.01)

(52) U.S. Cl.
CPC ..... *G03G 15/2085* (2013.01); *G03G 15/2053* (2013.01); *G03G 15/2089* (2013.01); *G03G 2215/2032* (2013.01); *G03G 2215/2035* (2013.01); *G03G 2215/2041* (2013.01)

(58) Field of Classification Search
CPC ..... G03G 15/2085
See application file for complete search history.

(56) References Cited

U.S. PATENT DOCUMENTS

2007/0218386 A1 9/2007 Suzuki et al.
2012/0034003 A1* 2/2012 Oda ..... G03G 15/10 399/320
2012/0070206 A1* 3/2012 Tsukioka ..... G03G 15/2032 399/328

(Continued)

FOREIGN PATENT DOCUMENTS

JP 9-230731 9/1997
JP 2007-034068 2/2007

(Continued)

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

A fixing device includes a fixing belt that is rotatable and a pressure rotator that is pressed against the fixing belt to form a fixing nip therebetween. A polishing roller separably contacts the fixing belt and slides over an outer circumferential surface of the fixing belt while the polishing roller is pressed against the fixing belt. At least one support supports and stretches the fixing belt. A polishing aid, which is disposed opposite the polishing roller via the fixing belt, supports and stretches the fixing belt. The polishing roller is disposed opposite the polishing aid via the fixing belt to form a polishing nip between the polishing roller and the fixing belt while the polishing roller is pressed against the fixing belt. The polishing roller changes a rotation locus of the fixing belt along at least a part of a circumferential face of the polishing roller.

19 Claims, 11 Drawing Sheets

(56) References Cited

U.S. PATENT DOCUMENTS

| | | | | |
|---|---|---|---|---|
| 2013/0164054 | A1* | 6/2013 | Hayashi | G03G 15/2025 399/329 |
| 2014/0270869 | A1* | 9/2014 | Okabayashi | G03G 15/2053 399/329 |
| 2014/0294455 | A1* | 10/2014 | Kotaka | G03G 15/2017 399/320 |
| 2016/0306304 | A1 | 10/2016 | Hemmi et al. | |
| 2016/0306306 | A1 | 10/2016 | Nozawa et al. | |
| 2017/0052492 | A1 | 2/2017 | Kawabe et al. | |

FOREIGN PATENT DOCUMENTS

| | | |
|---|---|---|
| JP | 2012-208170 | 10/2012 |
| JP | 2015-094921 | 5/2015 |
| JP | 2017-040698 | 2/2017 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. § 119 to Japanese Patent Application Nos. 2016-165718, filed on Aug. 26, 2016, and 2016-202869, filed on Oct. 14, 2016, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one embodiment, the fixing device includes a fixing belt rotatable in a rotation direction and a pressure rotator pressed against the fixing belt to form a fixing nip between the fixing belt and the pressure rotator. A polishing roller separably contacts the fixing belt and slides over an outer circumferential surface of the fixing belt while the polishing roller is pressed against the fixing belt. At least one support supports and stretches the fixing belt. A polishing aid, which is disposed opposite the polishing roller via the fixing belt, supports and stretches the fixing belt. The polishing roller is disposed opposite the polishing aid via the fixing belt to form a polishing nip between the polishing roller and the fixing belt while the polishing roller is pressed against the fixing belt. The polishing roller changes a rotation locus of the fixing belt along at least a part of a circumferential face of the polishing roller.

This specification further describes an improved image forming apparatus. In one embodiment, the image forming apparatus includes an image forming device to form a toner image and a fixing device disposed downstream from the image forming device in a recording medium conveyance direction to fix the toner image on a recording medium. The fixing device includes a fixing belt rotatable in a rotation direction and a pressure rotator pressed against the fixing belt to form a fixing nip between the fixing belt and the pressure rotator. A polishing roller separably contacts the fixing belt and slides over an outer circumferential surface of the fixing belt while the polishing roller is pressed against the fixing belt. At least one support supports and stretches the fixing belt. A polishing aid, which is disposed opposite the polishing roller via the fixing belt, supports and stretches the fixing belt. The polishing roller is disposed opposite the polishing aid via the fixing belt to form a polishing nip between the polishing roller and the fixing belt while the polishing roller is pressed against the fixing belt. The polishing roller changes a rotation locus of the fixing belt along at least a part of a circumferential face of the polishing roller.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
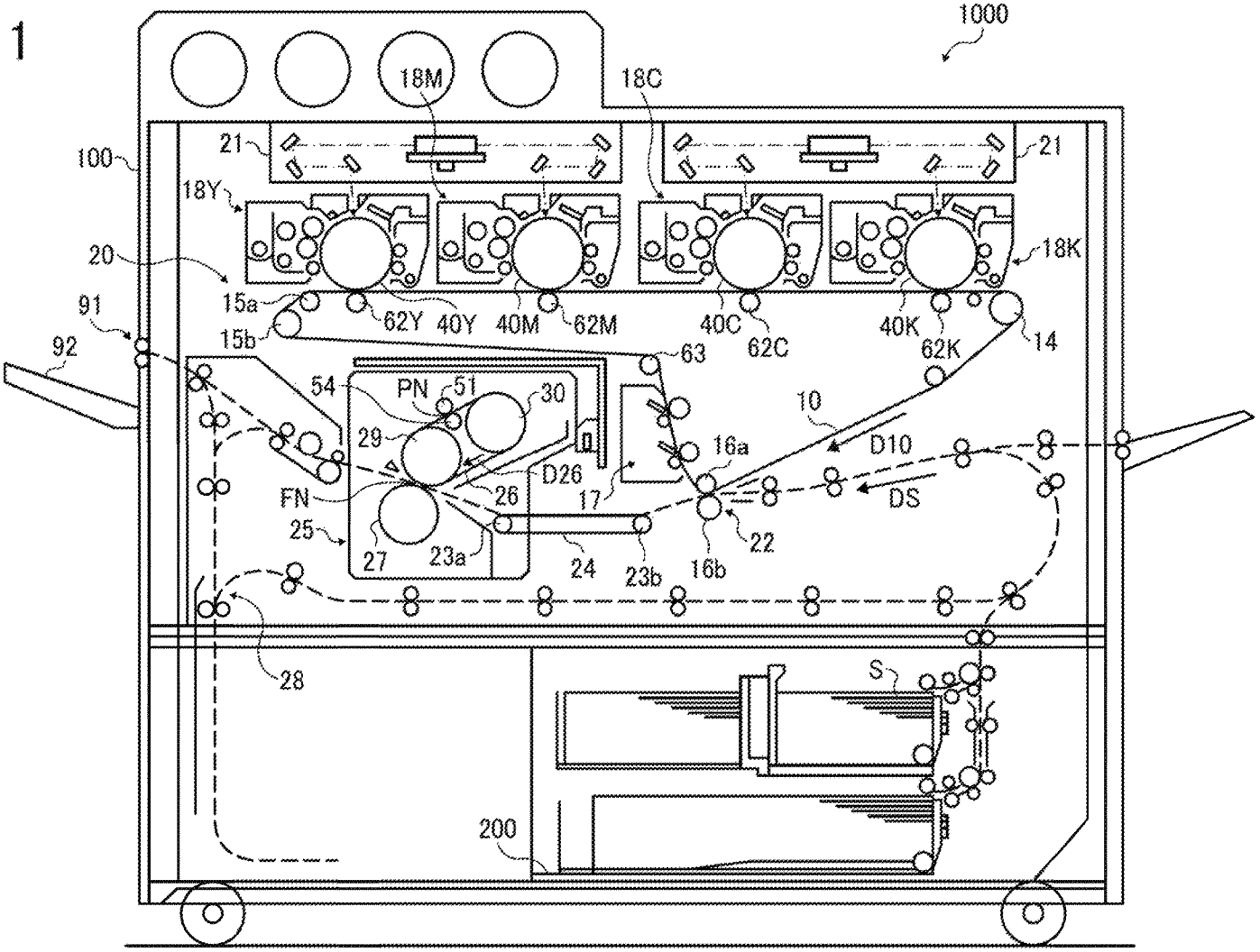
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1000 according to an embodiment is explained.

The image forming apparatus 1000 may be a copier, a facsimile machine, a printer, a multifunction peripheral or a multifunction printer (MFP) having at least one of copying, printing, scanning, facsimile, and plotter functions, or the like. According to this embodiment, the image forming apparatus 1000 is a color printer that forms a color toner image on a recording medium by electrophotography. Alternatively, the image forming apparatus 1000 may be a monochrome printer that forms a monochrome toner image on a recording medium.

Referring to FIG. 1, a description is provided of a construction of the image forming apparatus 1000.

FIG. 1 is a schematic vertical cross-sectional view of the image forming apparatus 1000 as one example. As illustrated in FIG. 1, the image forming apparatus 1000 is a printer employing a tandem intermediate transfer system. The image forming apparatus 1000 includes a body 100 and a sheet feed table 200 mounting the body 100.

The body 100 accommodates an image forming portion 20 employing the tandem intermediate transfer system (hereinafter referred to as a tandem image forming portion). The image forming portion 20 includes a plurality of image forming devices 18Y, 18M, 18C, and 18K aligned horizontally. Suffixes Y, M, C, and K represent yellow, magenta, cyan, and black, respectively.

An intermediate transfer belt 10 serving as an intermediate transferor (e.g., an endless belt) is situated in a sheet conveyance region and a substantially center portion of the body 100. The intermediate transfer belt 10 is looped over a plurality of rollers, that is, an intermediate transfer belt driving roller 14, intermediate transfer belt support rollers 15*a* and 15*b*, a secondary transfer opposed roller 16*a*, and the like. The intermediate transfer belt 10 is rotatable clockwise in FIG. 1 in a rotation direction D10.

On the left of the secondary transfer opposed roller 16*a* is an intermediate transfer belt cleaner 17. The intermediate transfer belt cleaner 17 removes residual toner failed to be transferred onto a sheet S and therefore remaining on the intermediate transfer belt 10 therefrom.

Above an upper face of the intermediate transfer belt 10 stretched taut across the intermediate transfer belt driving roller 14 and the intermediate transfer belt support rollers 15*a* and 15*b* are the four image forming devices 18Y, 18M, 18C, and 18K aligned horizontally in the rotation direction D10 of the intermediate transfer belt 10 to form yellow, magenta, cyan, and black toner images, respectively, thus constructing the tandem image forming portion 20. The image forming devices 18Y, 18M, 18C, and 18K of the tandem image forming portion 20 include photoconductive drums 40Y, 40M, 40C, and 40K serving as image bearers that bear yellow, magenta, cyan, and black toner images, respectively.

Above the tandem image forming portion 20 are two exposure devices 21. The left exposure device 21 is disposed opposite the two image forming devices 18Y and 18M. The right exposure device 21 is disposed opposite the two image forming devices 18C and 18K. For example, each of the exposure devices 21 employs an optical scanning method and includes two light sources (e.g., a semiconductor laser, a semiconductor laser array, or a multi-beam light source), a coupling optical system, a common optical deflector (e.g., a polygon mirror), and two scanning-image forming optical systems. The exposure devices 21 expose the photoconductive drums 40Y, 40M, 40C, and 40K according to yellow, magenta, cyan, and black image data, forming electrostatic latent images on the photoconductive drums 40Y, 40M, 40C, and 40K, respectively.

Each of the photoconductive drums 40Y, 40M, 40C, and 40K is surrounded by a developing device and a photoconductive drum cleaner. The developing device visualizes the electrostatic latent image that is formed by a charger and the exposure device 21 into a visible toner image, that is, yellow, magenta, cyan, and black toner images. Before the exposure devices 21 expose the photoconductive drums 40Y, 40M, 40C, and 40K, the chargers uniformly charge the photoconductive drums 40Y, 40M, 40C, and 40K, respectively. The photoconductive drum cleaners remove residual toner failed to be transferred onto the intermediate transfer belt 10 and therefore remaining on the photoconductive drums 40Y, 40M, 40C, and 40K therefrom, respectively.

Primary transfer rollers 62Y, 62M, 62C, and 62K serving as primary transferors are disposed opposite the photoconductive drums 40Y, 40M, 40C, and 40K via the intermediate transfer belt 10 to form primary transfer nips between the photoconductive drums 40Y, 40M, 40C, and 40K and the intermediate transfer belt 10, respectively, where the yellow magenta, cyan, and black toner images formed on the photoconductive drums 40Y, 40M, 40C, and 40K are primarily transferred onto the intermediate transfer belt 10 as a color toner image. The primary transfer rollers 62Y, 62M, 62C, and 62K are disposed opposite the photoconductive drums 40Y, 40M, 40C, and 40K with the intermediate transfer belt 10 sandwiched between the primary transfer rollers 62Y, 62M, 62C, and 62K and the photoconductive drums 40Y, 40M, 40C, and 40K, respectively.

The intermediate transfer belt driving roller 14 is a driving roller that drives and rotates the intermediate transfer belt 10. The intermediate transfer belt driving roller 14 is coupled to a motor through a driving force transmitter (e.g., a gear, a pulley, and a belt). In a print job to form a black toner image on the intermediate transfer belt 10, a mover moves the intermediate transfer belt support rollers 15*a* and 15*b* without moving the intermediate transfer belt driving roller 14. Thus, the mover isolates the intermediate transfer belt 10 from the photoconductive drums 40Y, 40M, and 40C used for forming yellow, magenta, and cyan toner images, respectively.

A secondary transfer device 22 is disposed opposite the tandem image forming portion 20 via the intermediate transfer belt 10. The secondary transfer device 22 includes a secondary transfer roller 16*b* pressed against the secondary transfer opposed roller 16*a* via the intermediate transfer belt 10. The secondary transfer roller 16*b* generates a transfer electric field to secondarily transfer the color toner image formed on the intermediate transfer belt 10 onto a sheet S (e.g., a transfer sheet) serving as a transfer medium or a recording medium.

Downstream from the secondary transfer device 22 in a sheet conveyance direction DS is a fixing device 25 that fixes the color toner image transferred from the intermediate transfer belt 10 onto the sheet S thereon. A detailed description of a construction of the fixing device 25 is deferred. The fixing device 25 includes a fixing belt 26 (e.g., an endless belt) and a pressure roller 27 pressed against the fixing belt 26. The fixing belt 26 is looped over a plurality of support rollers including a fixing roller 29 and a heating roller 30. A heater (e.g., a lamp or an induction heater employing an electromagnetic induction heating method) is disposed inside at least one of the support rollers (e.g., the heating roller 30).

A conveyance belt 24 supported by two conveyance belt support rollers 23*a* and 23*b* conveys the sheet S bearing the color toner image transferred from the intermediate transfer belt 10 by the secondary transfer device 22 to the fixing device 25. Instead of the conveyance belt 24, a stationary guide, a conveyance roller, or the like may be used.

Below the secondary transfer device 22 and the fixing device 25 is a sheet reverse device 28 disposed in parallelism with the tandem image forming portion 20. The sheet reverse device 28 reverses and conveys the sheet S for duplex printing to print another toner image on a back side of the sheet S. The sheet S bearing the fixed color toner image is ejected by an output roller pair 91 onto an output tray 92.

A description is provided of a construction of the fixing device 25.

The fixing device 25 (e.g., a fuser or a fusing unit) includes the fixing belt 26, the pressure roller 27, the fixing roller 29, the heating roller 30, a polishing roller 51, and a polishing aid roller 54. The fixing belt 26 is stretched taut across a plurality of supports and rotatable. The pressure roller 27 serving as a pressure rotator or a pressure member is pressed against the fixing roller 29 via the fixing belt 26 to form a fixing nip FN between the pressure roller 27 and the fixing belt 26. The polishing roller 51 separably contacts the fixing belt 26. The polishing roller 51 slides over an outer circumferential surface of the fixing belt 26 while the polishing roller 51 is pressed against the fixing belt 26. The polishing aid roller 54 is at least one of the plurality of supports. The polishing aid roller 54 serves as a polishing aid that is disposed opposite the polishing roller 51 via the fixing belt 26. While the polishing roller 51 is pressed against the fixing belt 26, the polishing roller 51 is disposed opposite the polishing aid roller 54 via the fixing belt 26 to form a polishing nip PN between the polishing roller 51 and the fixing belt 26. The polishing roller 51 changes a rotation locus of the fixing belt 26 along at least a part of a circumferential face of the polishing roller 51.

The plurality of supports across which the fixing belt 26 is stretched taut includes the fixing roller 29 and the heating roller 30. The fixing roller 29 presses against the pressure roller 27 via the fixing belt 26 to form the fixing nip FN between the fixing belt 26 and the pressure roller 27. The heating roller 30 heats the fixing belt 26.

Instead of the polishing aid roller 54, the fixing roller 29 or a support that is provided separately from the fixing roller 29 and the heating roller 30 may serve as a polishing aid.

A straight line connecting a center (e.g., an axis) of the polishing roller 51 and a center (e.g., an axis) of the polishing aid roller 54 and a straight line passing through the center of the polishing roller 51 and being perpendicular to an outer circumferential surface of the polishing aid roller 54 form an angle θ also called a wound angle. The angle θ is not smaller than 10 degrees, preferably not smaller than 20 degrees.

A surface layer of at least one of the polishing roller 51 and the polishing aid roller 54 includes an elastic body.

In order to bring the polishing roller 51 into contact with the fixing belt 26, the polishing roller 51 may move toward the polishing aid roller 54 or the polishing aid roller 54 may move toward the polishing roller 51. The polishing roller 51 may be removably attached to the fixing device 25 so that a user attaches the polishing roller 51 to the fixing device 25 to cause the polishing roller 51 to polish the fixing belt 26 and removes the polishing roller 51 from the fixing device 25 when the polishing roller 51 does not polish the fixing belt 26.

The polishing aid roller 54 may contact an inner circumferential surface of the fixing belt 26 constantly. The polishing aid roller 54 may exert tension to the fixing belt 26 to stretch the fixing belt 26. For example, the polishing aid roller 54 may be a tension roller. The polishing aid may be a rotator (e.g., a roller) or a pad. If the polishing aid is the pad, the pad increases a length of the polishing nip PN in a rotation direction D26 of the fixing belt 26. However, compared to a configuration in which the polishing aid is the rotator (e.g., the polishing aid roller 54), the pad may be susceptible to abrasion or the pad may cause the inner circumferential surface of the fixing belt 26 that contacts the pad to be susceptible to abrasion.

A description is provided of a configuration of a first comparative fixing device.

An electrophotographic image forming apparatus forms toner images of various sizes on sheets of various sizes and thicknesses.

After a plurality of small sheets is conveyed through the first comparative fixing device, when a large sheet is conveyed through the first comparative fixing device, a fixing belt may generate a gloss streak on the toner image on the large sheet at a portion of the fixing belt over which a lateral edge of the small sheets has slid. While the small sheets are conveyed over the fixing belt, the lateral edge of the small sheets may damage the fixing belt with a streaked scratch. Since burrs on a machined edge of the small sheet produce the streaked scratch on the fixing belt, the streaked scratch on the fixing belt is conspicuous as the number of the small sheets conveyed over the fixing belt increases.

To address this circumstance, the first comparative fixing device includes a polishing roller that restores the fixing belt damaged with the streaked scratch to suppress formation of a faulty toner image that suffers from the gloss streak.

The fixing belt is looped over a fixing roller and a heating roller. An opposed roller is interposed between the fixing roller and the heating roller. In order to polish the fixing belt sufficiently to prevent the gloss streak and decrease a total load imposed on the polishing roller, pressure with which the polishing roller contacts a center of the fixing belt in an axial direction thereof is smaller than pressure with which the polishing roller contacts a lateral end of the fixing belt in the axial direction thereof.

A description is provided of a configuration of a second comparative fixing device.

The second comparative fixing device includes a fixing roller and a polishing roller separably contacting the fixing roller. The polishing roller rotates separately from the fixing roller or in accordance with rotation of the fixing roller.

Since printing is not available while the polishing roller polishes the fixing roller, the polishing roller is requested to polish the fixing roller for a shortened time. To address this request, the polishing roller is driven and rotated separately from the fixing roller at a rotation velocity different from a rotation velocity of the fixing roller.

However, the polishing roller, while being driven and rotated separately from the fixing roller at the rotation velocity different from the rotation velocity of the fixing roller, may suffer from an increased total load and an increased driving torque. For example, a spring is anchored to a shaft of the polishing roller at each lateral end of the polishing roller in an axial direction thereof. The spring presses the polishing roller against the fixing roller or the fixing belt evenly. A gear mounted on one lateral end of the polishing roller in the axial direction thereof is driven and rotated. With such configuration, as a driving torque of the polishing roller increases, a reaction force against the driving torque generates on the gear. Accordingly, the polishing roller may not contact and press against the fixing roller or the fixing belt evenly. Consequently, one lateral end of the polishing roller may press against the fixing roller or the fixing belt with insufficient pressure, degrading polishing performance and increasing a polishing time taken to polish the fixing roller or the fixing belt.

Further, if the polishing roller contacts the fixing roller or the fixing belt in a small area, the polishing roller may polish the fixing roller or the fixing belt in a decreased polishing area. Accordingly, regardless of a driving method of the polishing roller, the polishing roller may not restore the fixing roller or the fixing belt satisfactorily when the polishing time is short.

Referring to drawings, a description is provided of embodiments of the present disclosure.

Figure 2:
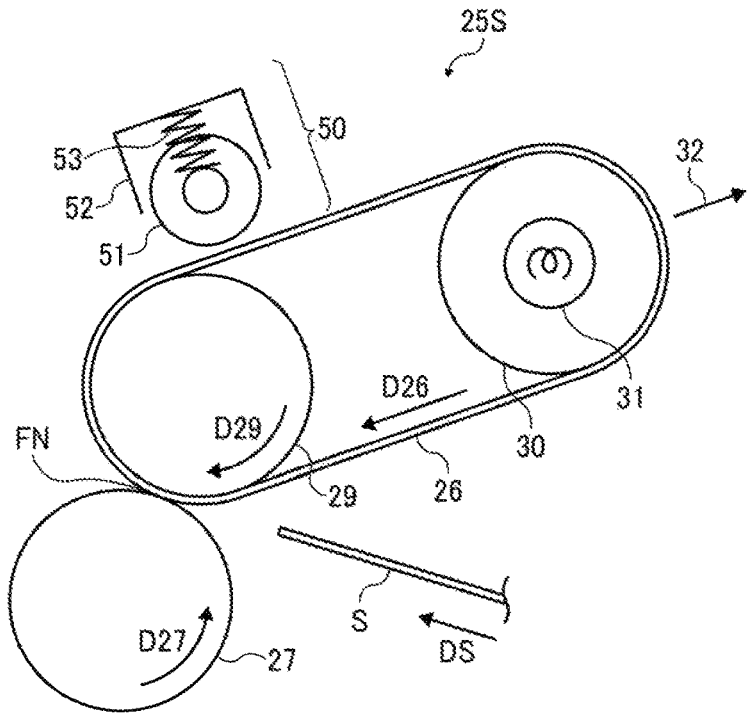
FIG. 2 is a vertical cross-sectional view of a fixing device according to a first embodiment installable in the image forming apparatus depicted in FIG. 1, illustrating a polishing roller being isolated from a fixing belt.
Figure 3:
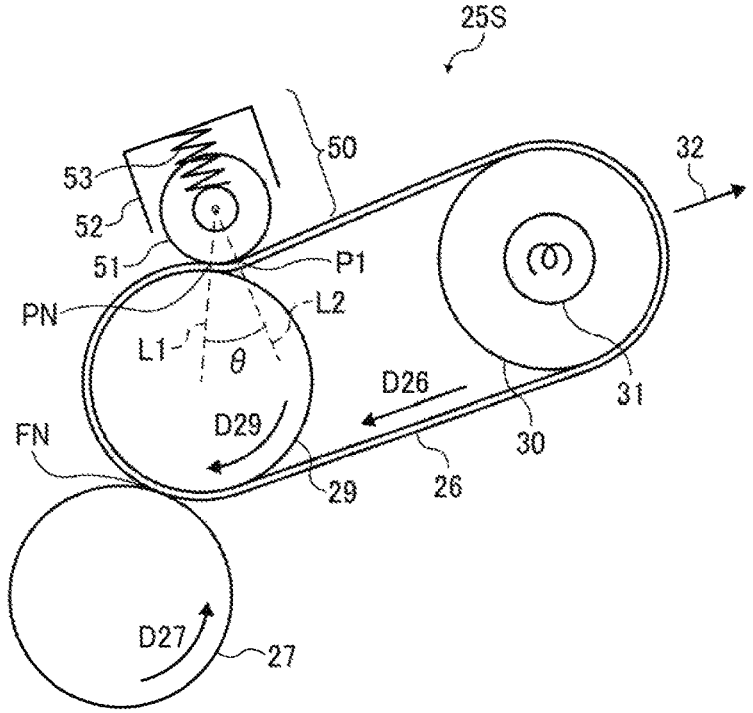
FIG. 3 is a vertical cross-sectional view of the fixing device depicted in FIG. 2, illustrating the polishing roller contacting the fixing belt.

Referring to FIGS. 2 and 3, a description is provided of a configuration of a fixing device 25S according to a first embodiment.

FIG. 2 is a vertical cross-sectional view of the fixing device 25S, illustrating the polishing roller 51 being isolated from the fixing belt 26. FIG. 3 is a vertical cross-sectional view of the fixing device 25S, illustrating the polishing roller 51 contacting the fixing belt 26. The fixing belt 26 is looped over the fixing roller 29 and the heating roller 30. The heating roller 30 accommodates a heater 31 serving as a heater or a heat source. The fixing roller 29 is rotatably mounted on or supported by a frame of the fixing device 25S. The heating roller 30 is rotatably mounted on or supported by the frame of the fixing device 25S such that the heating roller 30 is pulled by a spring in a direction 32. Thus, the heating roller 30 stretches the fixing belt 26.

The pressure roller 27 is pressed against the fixing roller 29 via the fixing belt 26. A driver drives and rotates the fixing roller 29 in a rotation direction D29 which in turn rotates the fixing belt 26 in the rotation direction D26. Alternatively, the driver may drive and rotate the pressure roller 27, instead of the fixing roller 29, in a rotation direction D27 which in turn rotates the fixing belt 26.

The fixing roller 29 includes a surface layer made of an elastic body. As the polishing roller 51 presses against the fixing roller 29 via the fixing belt 26, the surface layer of the fixing roller 29 deforms and produces the fixing nip FN between the fixing belt 26 and the pressure roller 27. According to this embodiment, the fixing nip FN has a length of 2.4 mm in the sheet conveyance direction DS, for example.

A polishing unit 50 includes the polishing roller 51, a holder 52 that holds the polishing roller 51, and a spring 53 that presses the polishing roller 51 against the fixing belt 26. A mover brings the polishing unit 50 into contact with the fixing belt 26 and separates the polishing unit 50 from the fixing belt 26. The mover is not restricted and employs general mechanisms. A driver may drive and rotate the polishing roller 51.

According to this embodiment, each of the fixing roller 29, the heating roller 30, and the pressure roller 27 has a diameter of 50 mm, for example. The polishing roller 51 has a diameter of 25 mm, for example.

FIG. 2 illustrates an isolation position of the polishing roller 51 where the polishing roller 51 is isolated from the fixing belt 26. FIG. 3 illustrates a contact position of the polishing roller 51 where the polishing roller 51 contacts the fixing belt 26. According to this embodiment, the polishing roller 51 contacts the fixing belt 26 at a separation start position P1 thereon where the fixing belt 26 rotating in the rotation direction D26 starts separating from the fixing roller 29. The separation start position P1 is situated in proximity to an end of a contact span in the rotation direction D26 of the fixing belt 26 where the fixing belt 26 contacts the fixing roller 29. The spring 53 presses the polishing roller 51 against the fixing roller 29 via the fixing belt 26.

As illustrated in FIG. 3, the spring 53 brings the polishing roller 51 into contact with the fixing belt 26 and presses the polishing roller 51 against the fixing belt 26, forming the polishing nip PN between the polishing roller 51 and the fixing belt 26. Simultaneously, the fixing belt 26 is wound around a part of the circumferential face of the polishing roller 51, changing the rotation locus of the fixing belt 26. Additionally, the fixing belt 26 is wound around the fixing roller 29 in an increased span in the rotation direction D26 of the fixing belt 26.

As the polishing roller 51 presses against the fixing belt 26, the polishing roller 51 engages the fixing belt 26 with a length of about 3 mm, for example. Accordingly, the fixing belt 26 displaces the heating roller 30 in a direction opposite the direction 32 in which the heating roller 30 exerts tension to the fixing belt 26. However, an amount of displacement of the heating roller 30 is slight, causing no disadvantage.

A straight line 1 connecting the center (e.g., the axis) of the polishing roller 51 and a center (e.g., an axis) of the fixing roller 29 serving as a polishing aid and a straight line L2 passing through the center of the polishing roller 51 and being perpendicular to the outer circumferential surface of the fixing belt 26 form the angle θ (e.g., the wound angle). The fixing belt 26 is wound around the polishing roller 51 in a wound span defined by the angle θ. In an example illustrated in FIG. 3, the angle θ is 25 degrees.

The angle θ formed when the polishing roller 51 is situated at the contact position where the polishing roller 51 contacts the fixing belt 26 as illustrated in FIG. 3 is greater than the angle θ formed when the polishing roller 51 is situated at the isolation position where the polishing roller 51 is isolated from the fixing belt 26 as illustrated in FIG. 2. A pressurization direction in which the spring 53 presses the polishing roller 51 against the fixing belt 26 is within the wound span defined by the angle θ. In the example illustrated in FIG. 3, the pressurization direction of the spring 53 is defined by the straight line L2 passing through the center of the polishing roller 51 and being perpendicular to the outer circumferential surface of the fixing belt 26.

The polishing nip PN formed between the fixing belt 26 and the polishing roller 51 has a length of 2.4 mm in the rotation direction 126 of the fixing belt 26. The angle θ formed by the straight lines L1 and L2 is 25 degrees. The polishing roller 51 contacts and slides over the fixing belt 26 at a predetermined circumferential velocity difference. Thus, the polishing roller 51 polishes the fixing belt 26. According to this embodiment, the polishing roller 51 slides over the fixing belt 26 in a forward direction at a linear velocity of the polishing roller 51 that is three times as fast as a surface linear velocity of the fixing belt 26. However, the linear velocity of the polishing roller 51 is not limited to the above.

Figure 4:
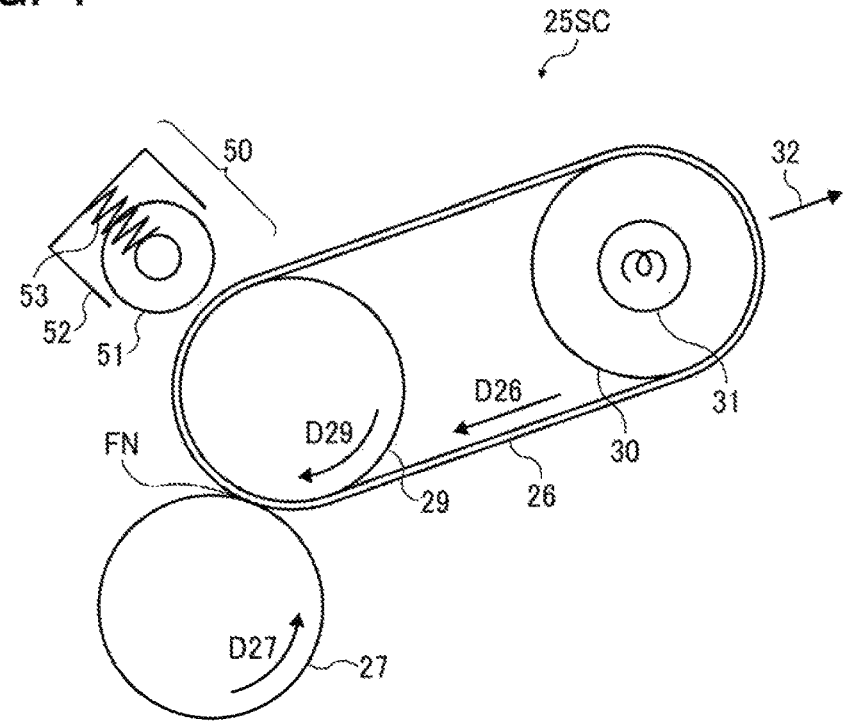
FIG. 4 is a vertical cross-sectional view of a fixing device as a first comparative example, illustrating the polishing roller being isolated from the fixing belt.
Figure 5:
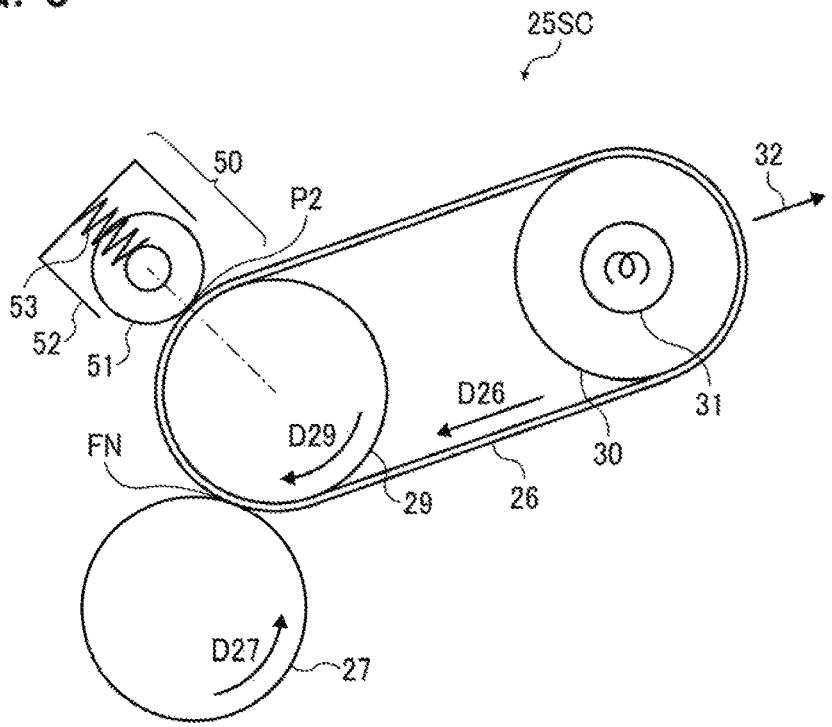
FIG. 5 is a vertical cross-sectional view of the fixing device depicted in FIG. 4, illustrating the polishing roller contacting the fixing belt.

Referring to FIGS. 4 and 5, a description is provided of a configuration of a fixing device 25SC according to a first comparative example.

FIG. 4 is a vertical cross-sectional view of the fixing device 25SC, illustrating the polishing roller 51 being isolated from the fixing belt 26. FIG. 5 is a vertical cross-sectional view of the fixing device 25SC, illustrating the polishing roller 51 contacting the fixing belt 26. The polishing roller 51 contacts the fixing belt 26 at a contact position P2 thereon where the fixing belt 26 is in contact with or wound around the fixing roller 29. The spring 53 presses the polishing roller 51 against the fixing roller 29 via the fixing belt 26. Accordingly, as illustrated in FIG. 5, even if the polishing roller 51 contacts the fixing belt 26, the fixing belt 26 is not wound around the polishing roller 51.

Conversely, according to the first embodiment illustrated in FIG. 3, the fixing belt 26 is wound around the polishing roller 51 in the wound span in the rotation direction D26 of the fixing belt 26 that is defined by the angle θ formed by the straight lines L1 and L2. Accordingly, the polishing roller 51 contacts the fixing belt 26 in a sufficient contact area, decreasing a polishing time taken to restore the outer circumferential surface of the fixing belt 26. For example, a polishing time according to the first embodiment depicted in FIG. 3 is shorter than a polishing time according to the first comparative example depicted in FIG. 4 by 20 percent.

Figure 6:
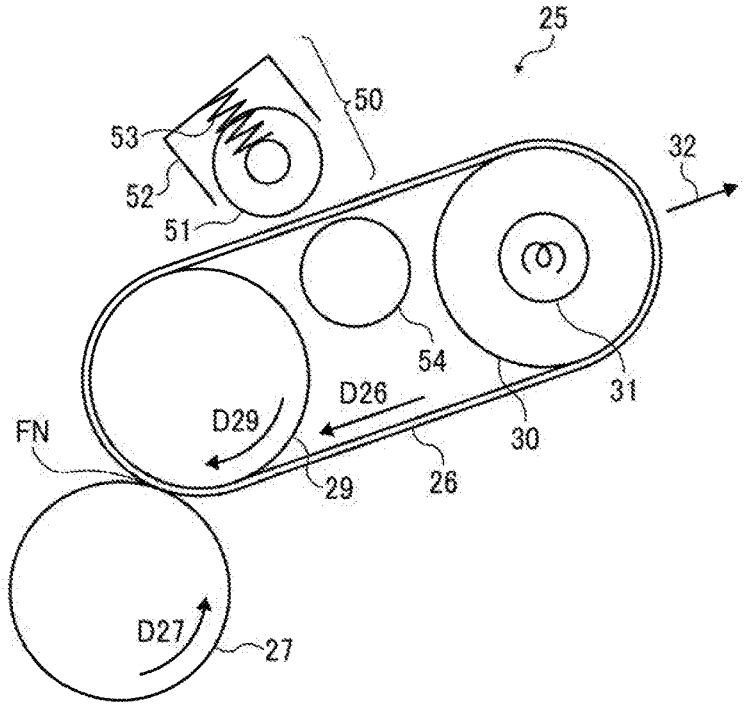
FIG. 6 is a vertical cross-sectional view of a fixing device according to a second embodiment incorporated in the image forming apparatus depicted in FIG. 1, illustrating the polishing roller being isolated from the fixing belt.
Figure 7:
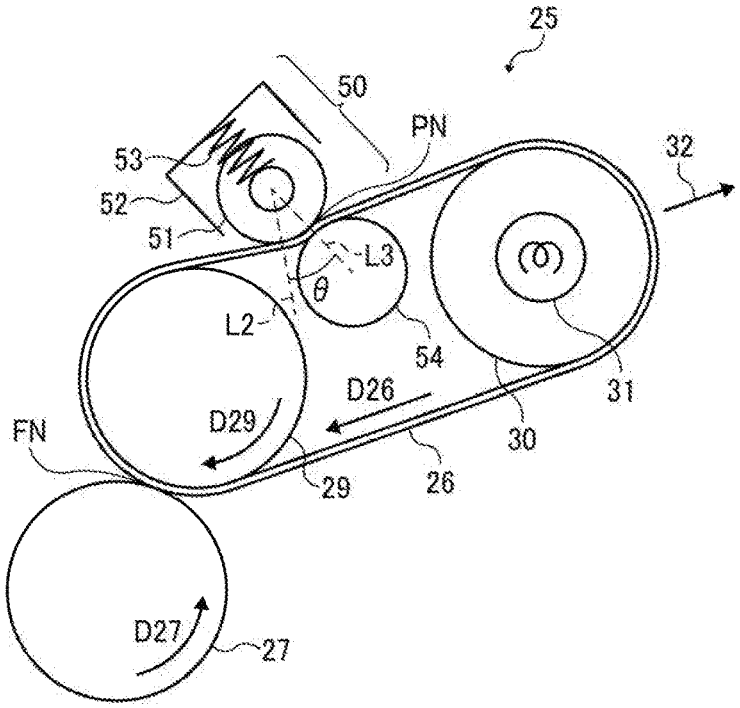
FIG. 7 is a vertical cross-sectional view of the fixing device depicted in FIG. 6, illustrating the polishing roller contacting the fixing belt.

Referring to FIGS. 6 and 7, a description is provided of a configuration of the fixing device 25 according to a second embodiment.

FIG. 6 is a vertical cross-sectional view of the fixing device 25, illustrating the polishing roller 51 being isolated from the fixing belt 26. FIG. 7 is a vertical cross-sectional view of the fixing device 25, illustrating the polishing roller 51 contacting the fixing belt 26. The fixing belt 26 is looped over the fixing roller 29 and the heating roller 30. The heating roller 30 accommodates the heater 31 serving as a heater or a heat source. The fixing roller 29 is rotatably mounted on or supported by a frame of the fixing device 25. The heating roller 30 is rotatably mounted on or supported by the frame of the fixing device 25 such that the heating roller 30 is pulled by the spring in the direction 32. Thus, the heating roller 30 stretches the fixing belt 26. According to this embodiment, the polishing aid roller 54 serving as a polishing aid is disposed inside a loop formed by the fixing belt 26. As illustrated in FIG. 6, the polishing aid roller 54 is rotatably supported by the frame of the fixing device 25 while the polishing aid roller 54 is isolated from the fixing belt 26. In an example illustrated in FIG. 6, the polishing aid roller 54 is isolated from the fixing belt 26 with an isolation interval of 1 mm.

The pressure roller 27 is pressed against the fixing roller 29 via the fixing belt 26. The driver drives and rotates the fixing roller 29 in the rotation direction D29 which in turn rotates the fixing belt 26 in the rotation direction D26. Alternatively, the driver may drive and rotate the pressure roller 27, instead of the fixing roller 29, in the rotation direction D27 which in turn rotates the fixing belt 26.

The polishing aid roller 54 includes the surface layer made of the elastic body. As the polishing roller 51 presses against the polishing aid roller 54 via the fixing belt 26, the surface layer of the polishing aid roller 54 deforms and produces the polishing nip PN between the fixing belt 26 and the polishing roller 5 disposed opposite the polishing aid roller 54. According to this embodiment, the polishing nip PN has a length of 2.0 mm in the rotation direction D26 of the fixing belt 26, for example. While the polishing aid roller 54 is isolated from the fixing belt 26 as illustrated in FIG. 6, the polishing aid roller 54 does not rotate.

The polishing unit 50 includes the polishing roller 51, the holder 52 that holds the polishing roller 51, and the spring 53 that presses the polishing roller 51 against the fixing belt 26. The mover brings the polishing unit 50 into contact with the fixing belt 26 and separates the polishing unit 50 from the fixing belt 26. The mover is not restricted and employs general mechanisms. The driver may drive and rotate the polishing roller 51.

According to this embodiment, each of the fixing roller 29, the heating roller 30, and the pressure roller 27 has the diameter of 50 mm, for example. Each of the polishing roller 51 and the polishing aid roller 54 has a diameter of 25 mm.

FIG. 6 illustrates an isolation position of the polishing roller 51 where the polishing roller 51 is isolated from the fixing belt 26. FIG. 7 illustrates a contact position of the polishing roller 51 where the polishing roller 51 contacts the fixing belt 26. According to this embodiment, the polishing roller 51 contacts the fixing belt 26 at a shift position shifted from a proximal position where the polishing aid roller 54 is in contact with or disposed in proximity to the fixing belt 26. The shift position is shifted from the proximal position of the polishing aid roller 54 in the rotation direction D26 of the fixing belt 26 or a direction opposite the rotation direction D26 of the fixing belt 26. In FIG. 7, the shift position is shifted from the proximal position of the polishing aid roller 54 leftward in the direction opposite the rotation direction D26 of the fixing belt 26. The spring 53 presses the polishing roller S1 against the polishing aid roller 54 via the fixing belt 26.

While the polishing aid roller 54 contacts the fixing belt 26 as illustrated in FIG. 7, the polishing aid roller 54 rotates in accordance with rotation of the fixing belt 26 while the polishing roller 51 polishes the fixing belt 26. As illustrated in FIG. 7, the spring 53 brings the polishing roller 51 into contact with the fixing belt 26 and presses the polishing roller 51 against the fixing belt 26, forming the polishing nip PN between the polishing roller 51 and the fixing belt 26. Simultaneously, the fixing belt 26 is wound around a part of the circumferential face of the polishing roller 51, changing the rotation locus of the fixing belt 26. Similarly, the fixing belt 26 is wound around the polishing aid roller 54 in a wound span in the rotation direction D26 of the fixing belt 26.

As the polishing roller 51 presses against the fixing belt 26, the polishing roller 51 engages the fixing belt 26 with a length of about 3 mm. Accordingly, the fixing belt 26 displaces the heating roller 30 in the direction opposite the direction 32 in which the heating roller 30 exerts tension to the fixing belt 26. However, an amount of displacement of the heating roller 30 is slight, causing no disadvantage.

A straight line L3 connecting the center (e.g., the axis) of the polishing roller 51 and the center (e.g., the axis) of the polishing aid roller 54 and the straight line L2 passing through the center of the polishing roller 51 and being perpendicular to the outer circumferential surface of the fixing belt 26 form an angle θ (e.g., a wound angle). The fixing belt 26 is wound around the polishing roller 51 in the wound span defined by the angle θ. In an example illustrated in FIG. 7, the angle θ is 29 degrees.

The angle θ formed when the polishing roller 51 is situated at the contact position where the polishing roller 51 contacts the fixing belt 26 as illustrated in FIG. 7 is greater than the angle θ formed when the polishing roller 51 is situated at the isolation position where the polishing roller 51 is isolated from the fixing belt 26 as illustrated in FIG. 6. The pressurization direction in which the spring 53 presses the polishing roller 51 against the fixing belt 26 is within the wound span defined by the angle θ. In the example illustrated in FIG. 7, the pressurization direction of the spring 53 is defined by the straight line L3 passing through the center of the polishing roller 51 and being perpendicular to the outer circumferential surface of the fixing belt 26.

The polishing nip PN formed between the fixing belt 26 and the polishing roller 51 has a length of 2.0 mm in the rotation direction D26 of the fixing belt 26. The angle θ formed by the straight lines L2 and L3 is 29 degrees. The polishing roller 51 contacts and slides over the fixing belt 26 at a predetermined circumferential velocity difference. Thus, the polishing roller 51 polishes the fixing belt 26. According to this embodiment, the polishing roller 51 slides over the fixing belt 26 in the forward direction at the linear velocity of the polishing roller 51 that is three times as fast as the surface linear velocity of the fixing belt 26. However, the linear velocity of the polishing roller 51 is not limited to the above. Accordingly, the polishing roller 51 contacts the fixing belt 26 in the sufficient contact area, decreasing the polishing time taken to restore the outer circumferential surface of the fixing belt 26.

According to the second embodiment illustrated in FIGS. 6 and 7, as the polishing unit 50 moves, the polishing roller 51 comes into contact with the fixing belt 26 and separates from the fixing belt 26. Alternatively, the polishing unit 50 may be stationary. In this case, as the polishing aid roller 54 moves, the polishing roller 51 comes into contact with the fixing belt 26 and separates from the fixing belt 26. Yet alternatively, the polishing aid roller 54 may be stationary and may not rotate in accordance with rotation of the fixing belt 26 while the fixing belt 26 slides over the polishing aid roller 54.

Figure 8:
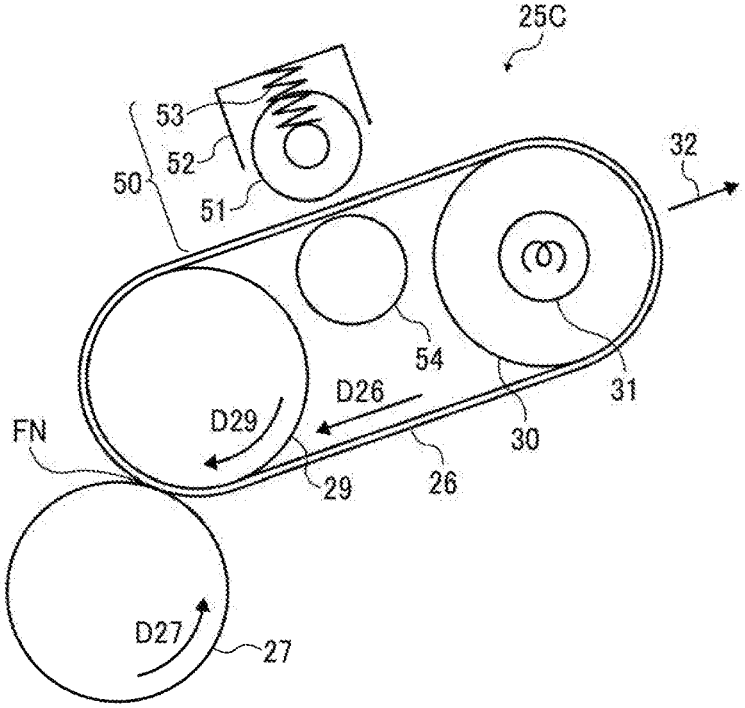
FIG. 8 is a vertical cross-sectional view of a fixing device as a second comparative example, illustrating the polishing roller being isolated from the fixing belt.
Figure 9:
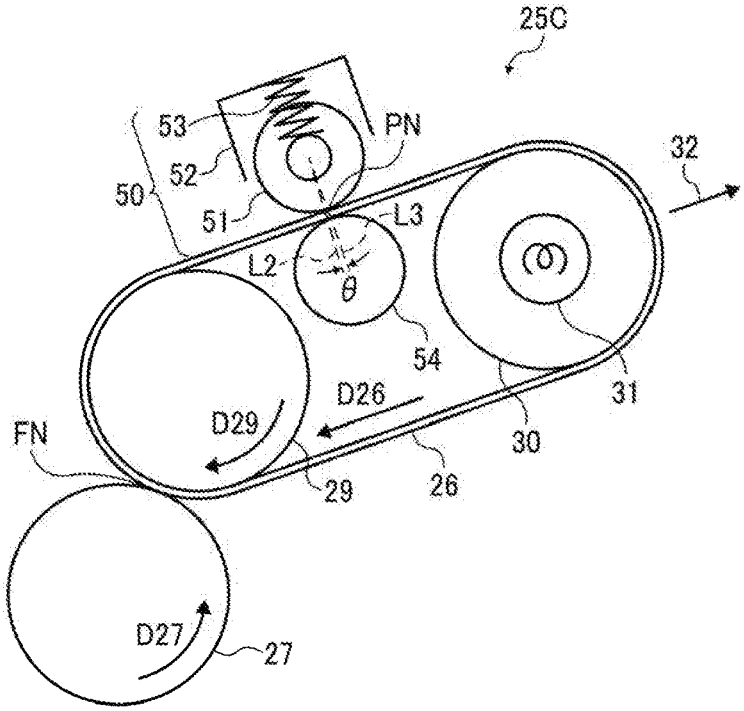
FIG. 9 is a vertical cross-sectional view of the fixing device depicted in FIG. 8, illustrating the polishing roller contacting the fixing belt.

Referring to FIGS. 8 and 9, a description is provided of a configuration of a fixing device 25C according to a second comparative example.

FIG. 8 is a vertical cross-sectional view of the fixing device 25C, illustrating the polishing roller 51 situated at an isolation position where the polishing roller 51 is isolated from the fixing belt 26. FIG. 9 is a vertical cross-sectional view of the fixing device 25C, illustrating the polishing roller 51 situated at a contact position where the polishing roller 51 contacts the fixing belt 26.

The fixing belt 26 is looped over the fixing roller 29 and the heating roller 30. The heating roller 30 accommodates the heater 31 serving as a heater or a heat source. The fixing roller 29 is rotatably mounted on or supported by a frame of the fixing device 25C. The heating roller 30 is rotatably mounted on or supported by the frame of the fixing device 25C such that the spring exerts tension to the heating roller 30 in the direction 32. Thus, the heating roller 30 stretches the fixing belt 26.

The pressure roller 27 is pressed against the fixing roller 29 via the fixing belt 26. The driver drives and rotates the fixing roller 29 in the rotation direction D29 which in turn rotates the fixing belt 26 in the rotation direction D26. Alternatively, the driver may drive and rotate the pressure roller 27, instead of the fixing roller 29, in the rotation direction D27 which in turn rotates the fixing belt 26.

As illustrated in FIG. 8, the polishing roller 51 is disposed outside the loop formed by the fixing belt 26 and is isolated from the fixing belt 26. The polishing aid roller 54 is disposed inside the loop formed by the fixing belt 26. The polishing aid roller 54 is rotatably supported by the frame of the fixing device 25C such that the polishing aid roller 54 is isolated from the fixing belt 26 slightly.

As illustrated in FIG. 9, the straight line L3 connecting the center of the polishing roller 51 and the center of the polishing aid roller 54 and the rotation locus of the fixing belt 26 form a substantially right angle.

The polishing roller 51 contacts the fixing belt 26 at a proximal position where the polishing aid roller 54 is in contact with or disposed in proximity to the fixing belt 26. The spring 53 presses the polishing roller 51 against the polishing aid roller 54 via the fixing belt 26. While the polishing roller 51 is at the isolation position illustrated in FIG. 8, the polishing aid roller 54 is isolated from the fixing belt 26 with an isolation interval of 1 mm. Accordingly, as illustrated in FIG. 9, although the fixing belt 26 is wound around the polishing roller S1 slightly, the fixing belt 26 is not wound around the polishing aid roller 54.

For example, as illustrated in FIG. 9, the straight line L3 connecting the center of the polishing roller 51 and the center of the polishing aid roller 54 and the straight line L2 passing through the center of the polishing roller 51 and being perpendicular to the outer circumferential surface of the fixing belt 26 form the angle θ (e.g., the wound angle) of 3 degrees. The polishing nip PN formed between the fixing belt 26 and the polishing roller 51 has a length of 0.6 mm in the rotation direction D26 of the fixing belt 26 that is calculated based on the angle θ of 3 degrees. The length of 0.6 mm of the polishing nip PN is within the length of 2.0 mm of the polishing nip PN described above by referring to FIG. 7, thus not increasing the wound span (e.g., a contact area) in the rotation direction D26 of the fixing belt 26 where the fixing belt 26 is wound around the polishing roller 51.

While the polishing aid roller 54 is isolated from the fixing belt 26 with the isolation interval not smaller than 1 mm as illustrated in FIG. 8, the polishing roller 51 engages the fixing belt 26 with an increased engagement amount, thus attaining the angle θ not smaller than 3 degrees with which the fixing belt 26 is wound around the polishing roller 51. However, the rotation locus of the fixing belt 26 changes excessively, degrading conveyance of the sheet S by the fixing belt 26.

A description is provided of disadvantages caused by driving of the polishing roller 51.

The holder 52 supports each lateral end of the polishing roller 51 in an axial direction thereof through the spring 53. The polishing roller 51 is driven and rotated by a gear mounted on a shaft situated at one lateral end of the polishing roller 51 in the axial direction thereof. As a cam or the like moves the polishing unit 50 toward the polishing aid roller 54, the polishing roller 51 presses against the fixing belt 26 as illustrated in FIG. 9.

As illustrated in FIG. 9, as a substantial driving torque generates on the shaft that mounts the gear of the polishing roller 51, a reaction force to the driving torque degrades a pressure balance between the springs 53 contacting both lateral ends of the polishing roller 51 in the axial direction thereof. Accordingly, the polishing roller 51 may not press against or contact the fixing belt 26 evenly throughout the entire span of the fixing belt 26 in an axial direction thereof. For example, the polishing roller 51 may press against one lateral end of the fixing belt 26 but may not press against another lateral end of the fixing belt 26 in the axial direction thereof. In order to cause the polishing roller 51 to polish the another lateral end of the fixing belt 26 that is not pressed by the polishing roller 51 sufficiently so as to restore the fixing belt 26 to a predetermined condition, the polishing time when the polishing roller 51 polishes the fixing belt 26 may increase.

The straight line L3 connecting the center of the polishing roller 51 and the center of the polishing aid roller 54 and the rotation locus of the fixing belt 26 form the substantially right angle. Accordingly, the fixing belt 26 may be barely wound around the polishing roller 51, resulting in an insufficient contact area where the polishing roller 51 contacts the fixing belt 26 and an increased polishing time taken for the polishing roller 51 to polish the fixing belt 26.

Figure 10:
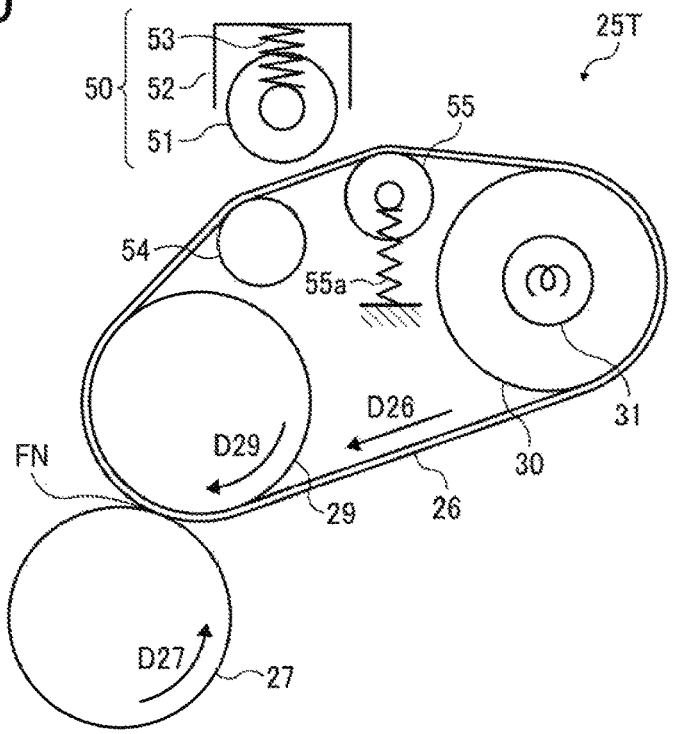
FIG. 10 is a vertical cross-sectional view of a fixing device according to a third embodiment installable in the image forming apparatus depicted in FIG. 1, illustrating the polishing roller being isolated from the fixing belt.
Figure 11:
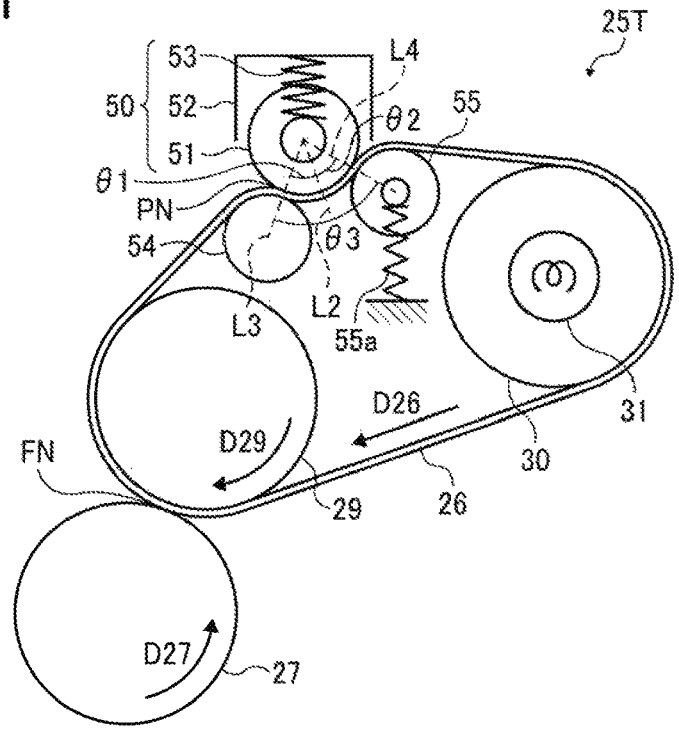
FIG. 11 is a vertical cross-sectional view of the fixing device depicted in FIG. 10, illustrating the polishing roller contacting the fixing belt.

Referring to FIGS. 10 and 11, a description is provided of a configuration of a fixing device 25T according to a third embodiment.

FIG. 10 is a vertical cross-sectional view of the fixing device 25T, illustrating the polishing roller 51 being isolated from the fixing belt 26. FIG. 11 is a vertical cross-sectional view of the fixing device 25T, illustrating the polishing roller 51 contacting the fixing belt 26. FIG. 10 illustrates an isolation position of the polishing roller 51 where the polishing roller 51 is isolated from the fixing belt 26. FIG. 11 illustrates a contact position of the polishing roller 51 where the polishing roller 51 contacts the fixing belt 26.

The fixing belt 26 is looped over the fixing roller 29 and the heating roller 30. The heating roller 30 accommodates the heater 31 serving as a heater or a heat source. The fixing roller 29 and the heating roller 30 are rotatably mounted on or supported by a frame of the fixing device 25T. Thus, the fixing roller 29 and the heating roller 30 stretch the fixing belt 26.

According to this embodiment, the polishing aid roller 54 and a tension roller 55 serving as polishing aids are disposed inside the loop formed by the fixing belt 26. The polishing aid roller 54 also serves as a first polishing aid or a first polishing aid roller and the tension roller 55 also serves as a second polishing aid or a second polishing aid roller. The polishing aid roller 54, together with the fixing roller 29 and the heating roller 30, is rotatably mounted on or supported by the frame of the fixing device 25T. The tension roller 55 is rotatably mounted on or supported by the frame of the fixing device 25T such that a spring 55*a* causes the tension roller 55 to exert tension to the inner circumferential surface of the fixing belt 26 outward. Thus, the tension roller 55 stretches the fixing belt 26.

The pressure roller 27 is pressed against the fixing roller 29 via the fixing belt 26. The driver drives and rotates the fixing roller 29 in the rotation direction D29 which in turn rotates the fixing belt 26 in the rotation direction D26. Alternatively, the driver may drive and rotate the pressure roller 27, instead of the fixing roller 29, in the rotation direction D27 which in turn rotates the fixing belt 26.

The polishing aid roller 54 includes the surface layer made of the elastic body. As the polishing roller 51 presses against the polishing aid roller 54 via the fixing belt 26, the surface layer of the polishing aid roller 54 deforms and produces the polishing nip PN between the fixing belt 26 and the polishing roller S1 disposed opposite the polishing aid roller 54. According to this embodiment, the polishing nip PN has a length of 1.8 mm in the rotation direction D26 of the fixing belt 26.

The polishing unit 50 includes the polishing roller 51, the holder 52 that holds the polishing roller 51, and the spring 53 that presses the polishing roller 51 against the fixing belt 26. The mover brings the polishing unit 50 into contact with the fixing belt 26 and separates the polishing unit 50 from the fixing belt 26. The mover is not restricted and employs general mechanisms. The driver may drive and rotate the polishing roller 51.

According to this embodiment, each of the fixing roller 29, the heating roller 30, and the pressure roller 27 has the diameter of 50 mm. Each of the polishing roller 51, the polishing aid roller 54, and the tension roller 55 has a diameter of 25 mm.

According to this embodiment, the polishing roller 51 contacts the fixing belt 26 in an interval between the polishing aid roller 54 and the tension roller 55 in the rotation direction D26 of the fixing belt 26. The spring 53 presses the polishing roller 51 against the polishing aids, that is, the polishing aid roller 54 and the tension roller 55, via the fixing belt 26.

As illustrated in FIG. 11, the spring 53 brings the polishing roller 51 into contact with the fixing belt 26 and presses the polishing roller 51 against the fixing belt 26, forming the polishing nip PN between the polishing roller 51 and the fixing belt 26. Simultaneously, the fixing belt 26 is wound around a part of the circumferential face of the polishing roller 51, changing the rotation locus of the fixing belt 26. Similarly, the fixing belt 26 is wound around the polishing aid roller 54 and the tension roller 55 in a wound span in the rotation direction D26 of the fixing belt 26.

As the polishing roller 51 presses against the fixing belt 26, the polishing roller 51 engages the fixing belt 26 with a length of about 5.5 mm, thus displacing the tension roller 55.

However, an amount of displacement of the tension roller 55 is slight, causing no disadvantage.

The straight line L3 connecting the center (e.g., the axis) of the polishing roller 51 and the center (e.g., the axis) of the polishing aid roller 54 and the straight line L2 passing through the center of the polishing roller 51 and being perpendicular to the outer circumferential surface of the fixing belt 26 form an angle θ1 (e.g., a wound angle). A straight line L4 connecting the center (e.g., the axis) of the polishing roller 51 and a center (e.g., an axis) of the tension roller 55 serving as a polishing aid and the straight line L2 passing through the center of the polishing roller 51 and being perpendicular to the outer circumferential surface of the fixing belt 26 form an angle θ2 (e.g., a wound angle). The angles θ1 and θ2 are combined into an angle θ3 (e.g., a wound angle). The fixing belt 26 is wound around the polishing roller 51 in a wound span defined by the angle θ3. In an example illustrated in FIG. 11, the angle θ3 is 80 degrees.

The angle θ3 formed when the polishing roller 51 is situated at the contact position where the polishing roller 51 contacts the fixing belt 26 as illustrated in FIG. 11 is greater than the angle θ3 formed when the polishing roller 51 is situated at the isolation position where the polishing roller 51 is isolated from the fixing belt 26 as illustrated in FIG. 10. The pressurization direction in which the spring 53 presses the polishing roller 51 against the fixing belt 26 is within the wound span defined by the angle θ3.

The polishing nip PN formed between the fixing belt 26 and the polishing roller 51 has a length of 1.8 mm in the rotation direction D26 of the fixing belt 26. The polishing roller 51 contacts the fixing belt 26 to create the angle θ3 of 80 degrees. The polishing roller 51 slides over the fixing belt 26 at the predetermined circumferential velocity difference. Thus, the polishing roller 51 polishes the fixing belt 26. According to this embodiment, the polishing roller 51 slides over the fixing belt 26 in the forward direction at the linear velocity of the polishing roller 51 that is three times as fast as the surface linear velocity of the fixing belt 26. However, the linear velocity of the polishing roller 51 is not limited to the above. Accordingly, the polishing roller 51 contacts the fixing belt 26 in the sufficient contact area, decreasing the polishing time taken to restore the outer circumferential surface of the fixing belt 26.

Figure 12:
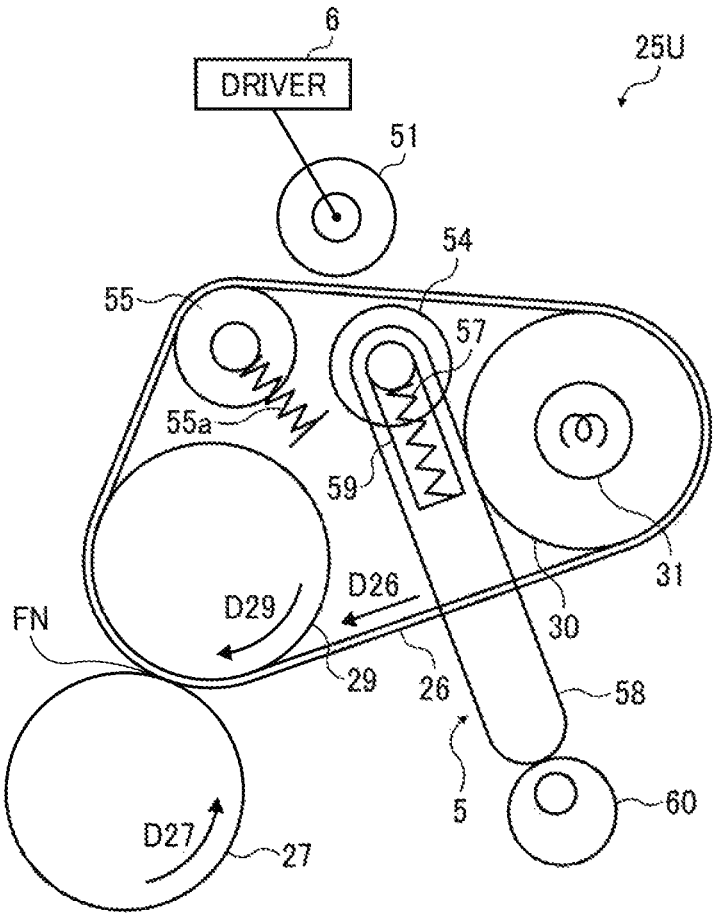
FIG. 12 is a vertical cross-sectional view of a fixing device according to a fourth embodiment installable in the image forming apparatus depicted in FIG. 1, illustrating the polishing roller being isolated from the fixing belt.
Figure 13:
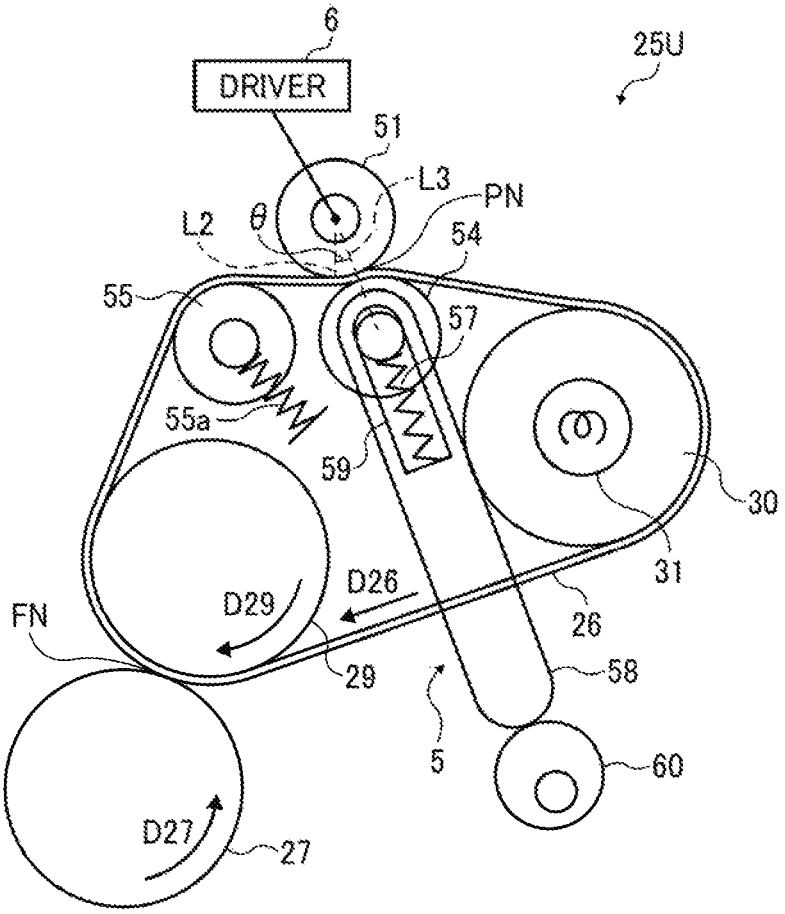
FIG. 13 is a vertical cross-sectional view of the fixing device depicted in FIG. 12, illustrating the polishing roller contacting the fixing belt.

Referring to FIGS. 12 and 13, a description is provided of a configuration of a fixing device 25U according to a fourth embodiment.

FIG. 12 is a vertical cross-sectional view of the fixing device 25U, illustrating the polishing roller 51 being isolated from the fixing belt 26. FIG. 13 is a vertical cross-sectional view of the fixing device 25U, illustrating the polishing roller 51 contacting the fixing belt 26. FIG. 12 illustrates an isolation position of the polishing roller 51 where the polishing roller 51 is isolated from the fixing belt 26. FIG. 13 illustrates a contact position of the polishing roller 51 where the polishing roller 51 contacts the fixing belt 26.

The fixing device 25U includes the fixing belt 26 looped over the fixing roller 29, the heating roller 30, and the tension roller 55. The heating roller 30 accommodates the heater 31 serving as a heater or a heat source. The fixing roller 29 and the heating roller 30 are rotatably mounted on or supported by a frame of the fixing device 25U. The fixing device 25U further includes the polishing aid roller 54 and a pressurization assembly that presses the polishing aid roller 54 against the polishing roller 51 via the fixing belt 26. The fixing device 25U further includes the tension roller 55. The tension roller 55 is rotatably mounted on or supported by the frame of the fixing device 25U such that the spring 55*a* causes the tension roller 55 to exert tension to the inner circumferential surface of the fixing belt 26 outward. Thus, the tension roller 55 stretches the fixing belt 26.

The pressure roller 27 is pressed against the fixing roller 29 via the fixing belt 26. The driver drives and rotates the fixing roller 29 in the rotation direction D29 which in turn rotates the fixing belt 26 in the rotation direction D26. Alternatively, the driver may drive and rotate the pressure roller 27, instead of the fixing roller 29, in the rotation direction D27 which in turn rotates the fixing belt 26.

The polishing aid roller 54 is disposed inside the loop formed by the fixing belt 26. Each lateral end of the polishing aid roller 54 in an axial direction thereof is supported by the frame of the fixing device 25U such that each lateral end of the polishing aid roller 54 is slidable in an elongate hole 59 of a holder 58. A spring 57 serving as a presser is anchored to the holder 58 and the polishing aid roller 54. The spring 57 biases each lateral end of the polishing aid roller 54 in the axial direction thereof toward the fixing belt 26. The polishing aid roller 54, the holder 58, and the spring 57 construct a polishing aid roller unit 5. The polishing aid roller unit 5 is supported by the frame of the fixing device 25U such that the polishing aid roller unit 5 is slidable in a longitudinal direction thereof. A cam 60 disposed opposite the polishing aid roller 54 via the holder 58 moves and slides the polishing aid roller unit 5.

The polishing roller 51 is disposed outside the loop formed by the fixing belt 26. The polishing roller 51 is rotatably supported by the frame of the fixing device 25U and is disposed opposite the polishing aid roller 54 disposed inside the loop formed by the fixing belt 26. A driver 6 coupled to the polishing roller 51 drives and rotates the polishing roller 51 through the gear mounted on the shaft situated at one lateral end of the polishing roller 51 in the axial direction thereof. Since the polishing roller 51 is supported by the frame of the fixing device 25U against a reaction force that generates as the polishing roller 51 is driven and rotated, even if a force that drives and rotates the polishing roller 51 is great, the polishing roller 51 rotates stably.

The polishing aid roller 54 includes the surface layer made of the elastic body. As the polishing roller 51 presses against the polishing aid roller 54 via the fixing belt 26, the surface layer of the polishing aid roller 54 deforms and produces the polishing nip PN between the fixing belt 26 and the polishing roller 51 disposed opposite the polishing aid roller 54. According to this embodiment, the polishing nip PN has a length of 1.8 mm in the rotation direction D26 of the fixing belt 26.

According to this embodiment, each of the fixing roller 29, the heating roller 30, and the pressure roller 27 has the diameter of 50 mm. Each of the polishing roller 51, the polishing aid roller 54, and the tension roller 55 has the diameter of 25 mm.

Referring to FIG. 12, a description is provided of the isolation position of the polishing roller 51 where the polishing roller 51 is isolated from the fixing belt 26.

The polishing roller 51 is isolated from the fixing belt 26 slightly. As the cam 60 rotates, the cam 60 moves and slides the polishing aid roller unit 5 to an isolation position where the polishing aid roller unit 5 isolates the polishing aid roller 54 from the inner circumferential surface of the fixing belt 26. The spring 57 presses the polishing aid roller 54 against one end of the elongate hole 59 of the holder 58.

Referring to FIG. 13, a description is provided of the contact position of the polishing roller 51 where the polishing roller 51 contacts the fixing belt 26.

As the cam 60 rotates, the cam 60 moves and slides the polishing aid roller unit 5 so that the polishing aid roller 54 moves toward the polishing roller 51. While the cam 60 rotates, the polishing aid roller 54 comes into contact with the fixing belt 26. As the cam 60 rotates further, the polishing aid roller 54 presses against the polishing roller 51 via the fixing belt 26. As the cam 60 finishes rotation, the polishing aid roller 54 separates from the elongate hole 59 of the holder 58. Thus, the spring 57 presses the polishing aid roller 54 against the polishing roller 51 via the fixing belt 26.

As illustrated in FIG. 13, the spring 57 presses the polishing aid roller 54 against the polishing roller 51 via the fixing belt 26, forming the polishing nip PN between the polishing roller 51 and the fixing belt 26. Simultaneously, the fixing belt 26 is wound around a part of the circumferential face of the polishing roller 51, changing the rotation locus of the fixing belt 26. Since the fixing device 25U includes the tension roller 55, even when the rotation locus of the fixing belt 26 changes, the tension roller 55 exerts an appropriate tension to the fixing belt 26 constantly.

The straight line L3 connecting the center (e.g., the axis) of the polishing roller 51 and the center (e.g., the axis) of the polishing aid roller 54 and the straight line L2 passing through the center of the polishing roller 51 and being perpendicular to the outer circumferential surface of the fixing belt 26 form the angle θ (e.g., a wound angle). The fixing belt 26 is wound around the polishing roller 51 in the wound span defined by the angle θ. In an example illustrated in FIG. 13, the angle θ is 19 degrees.

The spring 57 presses the polishing aid roller 54 against the polishing roller 51 via the fixing belt 26. Accordingly, the polishing nip PN formed between the fixing belt 26 and the polishing roller 51 has a length of 1.8 mm in the rotation direction D26 of the fixing belt 26 with the angle θ of 19 degrees.

The driver 6 coupled to at least one lateral end of the polishing roller 51 in the axial direction thereof drives and rotates the polishing roller 51 such that the polishing roller 51 slides over the fixing belt 26 rotating in the rotation direction D26 with the predetermined circumferential velocity difference. Thus, the polishing roller 51 polishes the fixing belt 26. According to this embodiment, the polishing roller 51 slides over the fixing belt 26 in the forward direction at the linear velocity of the polishing roller 51 that is three times as fast as the surface linear velocity of the fixing belt 26. However, the linear velocity of the polishing roller 51 is not limited to the above.

With the construction of the fixing device 25U depicted in FIGS. 12 and 13, the fixing belt 26 contacts and presses against the polishing roller 51 evenly. Additionally, the polishing roller 51 contacts the fixing belt 26 in a sufficient contact area, decreasing a polishing time taken to restore the outer circumferential surface of the fixing belt 26.

Figure 14:
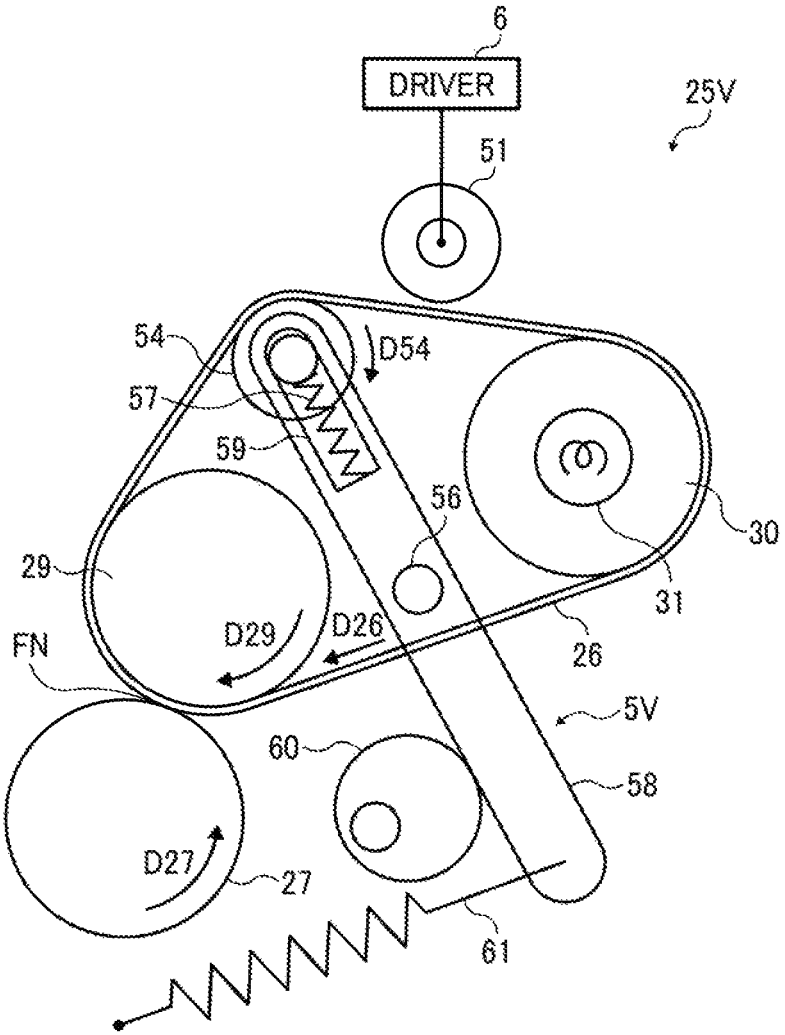
FIG. 14 is a vertical cross-sectional view of a fixing device according to a fifth embodiment installable in the image forming apparatus depicted in FIG. 1, illustrating the polishing roller being isolated from the fixing belt.
Figure 15:
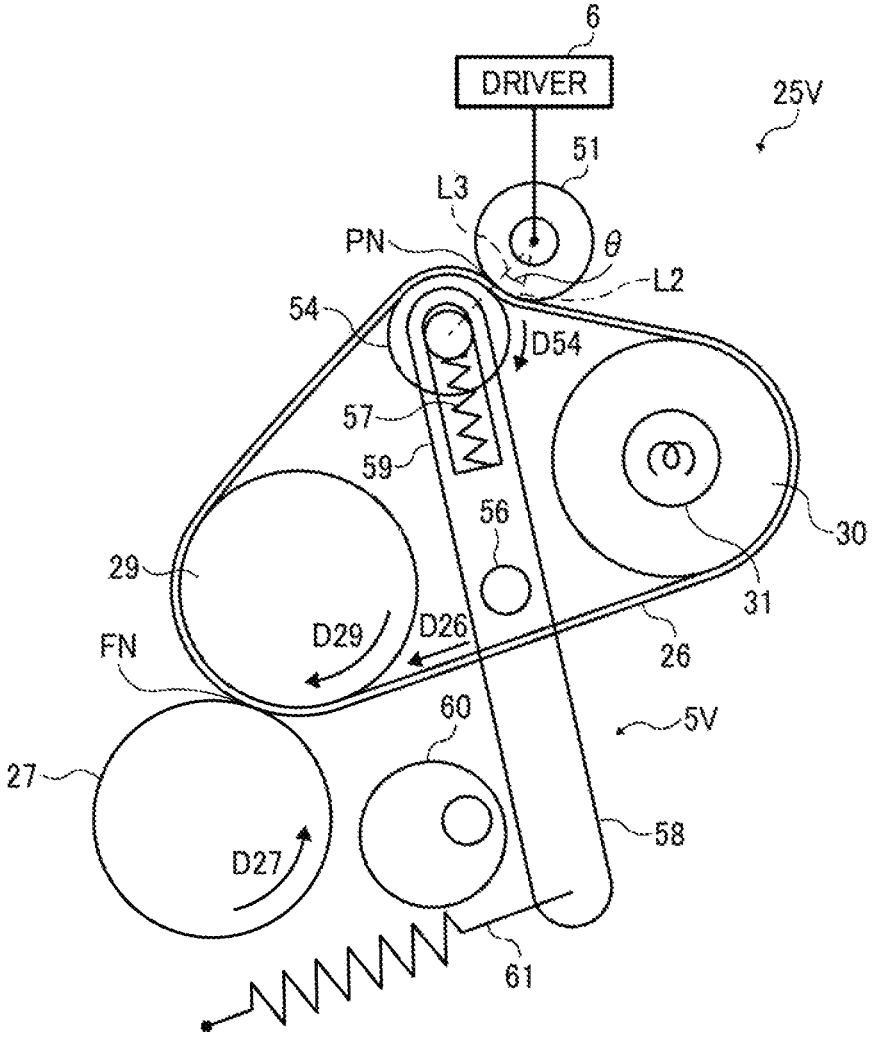
FIG. 15 is a vertical cross-sectional view of the fixing device depicted in FIG. 14, illustrating the polishing roller contacting the fixing belt.

Referring to FIGS. 14 and 15, a description is provided of a configuration of a fixing device 25V according to a fifth embodiment.

FIG. 14 is a vertical cross-sectional view of the fixing device 25V, illustrating the polishing roller 51 being isolated from the fixing belt 26. FIG. 15 is a vertical cross-sectional view of the fixing device 25V, illustrating the polishing roller 51 contacting the fixing belt 26. FIG. 14 illustrates an isolation position of the polishing roller 51 where the polishing roller 51 is isolated from the fixing belt 26. FIG. 15 illustrates a contact position of the polishing roller 51 where the polishing roller 51 contacts the fixing belt 26.

The fixing belt 26 is looped over the fixing roller 29, the heating roller 30, and the polishing aid roller 54 also serving as a tension roller. The heating roller 30 accommodates the heater 31 serving as a heater or a heat source. The fixing roller 29 and the heating roller 30 are rotatably mounted on or supported by a frame of the fixing device 25V. The polishing aid roller 54 is rotatably mounted on or supported by the frame of the fixing device 25V such that the spring 57 causes the polishing aid roller 54 to exert tension to the inner circumferential surface of the fixing belt 26 outward. Thus, the polishing aid roller 54 exerts tension to the fixing belt 26 and stretches the fixing belt 26.

The fixing device 25V according to the fifth embodiment incorporates the polishing aid roller 54 that attains the functions of the polishing aid roller 54 and the tension roller 55 separately provided from the polishing aid roller 54, which are incorporated in the fixing device 25U according to the fourth embodiment depicted in FIGS. 12 and 13. Accordingly, the fixing device 25V reduces the number of parts incorporated therein and shortens the circumferential length of the fixing belt 26, downsizing the fixing device 25V.

The pressure roller 27 is pressed against the fixing roller 29 via the fixing belt 26. The driver drives and rotates the fixing roller 29 in the rotation direction D29 which in turn rotates the fixing belt 26 in the rotation direction D26. Alternatively, the driver may drive and rotate the pressure roller 27, instead of the fixing roller 29, in the rotation direction D27 which in turn rotates the fixing belt 26.

Each lateral end of the polishing aid roller 54 in the axial direction thereof is supported by the frame of the fixing device 25V such that each lateral end of the polishing aid roller 54 is slidable in the elongate hole 59 of the holder 58. The spring 57 biases each lateral end of the polishing aid roller 54 in the axial direction thereof toward the fixing belt 26. The fixing device 25V includes a polishing aid roller unit 5V that includes the polishing aid roller 54, the holder 58 provided with the elongate hole 59, the spring 57, and a shaft 56. The shaft 56 (e.g., a fulcrum) is disposed at substantially a center of the holder 58 or the polishing aid roller unit 5V in a longitudinal direction thereof. As the holder 58 pivots about the shaft 56, the polishing aid roller 54 supported by the holder 58 moves. The cam 60 is disposed opposite the polishing aid roller 54 via the holder 58. The cam 60 and a spring 61 rotate the polishing aid roller 54 and press the polishing aid roller 54 against the fixing belt 26.

The spring 57 biases the polishing aid roller 54 in a separation direction in which the polishing aid roller 54 separates from the shaft 56. The spring 61 biases the polishing aid roller 54 to pivot about the shaft 56. A biasing direction in which the spring 57 biases the polishing aid roller 54 is substantially perpendicular to a biasing direction in which the spring 61 biases the polishing aid roller 54.

The polishing roller 51 is disposed outside the loop formed by the fixing belt 26. The polishing roller 51 is rotatably supported by the frame of the fixing device 25V and is disposed counter to a rotation direction D54 of the polishing aid roller 54 disposed inside the loop formed by the fixing belt 26. The driver 6 coupled to the polishing roller 51 drives and rotates the polishing roller 51 through the gear mounted on the shaft situated at one lateral end of the polishing roller 51 in the axial direction thereof. Since the polishing roller 51 is supported by the frame of the fixing device 25V against a reaction force that generates as the polishing roller 51 is driven and rotated, even if a force that drives and rotates the polishing roller 51 is great, the polishing roller 51 rotates stably.

The polishing aid roller 54 includes the surface layer made of the elastic body. As the polishing roller 51 presses against the polishing aid roller 54 via the fixing belt 26, the surface layer of the polishing aid roller 54 deforms and produces the polishing nip PN between the fixing belt 26 and the polishing roller 51 disposed opposite the polishing aid roller 54. According to this embodiment, the polishing nip PN has a length of 1.8 mm in the rotation direction D26 of the fixing belt 26.

According to this embodiment, each of the fixing roller 29, the heating roller 30, and the pressure roller 27 has the diameter of 50 mm. Each of the polishing roller 51 and the polishing aid roller 54 has the diameter of 25 mm.

As illustrated in FIG. 14, when the polishing roller 51 is isolated from the fixing belt 26 slightly, the cam 60 moves the polishing aid roller unit 5V and the polishing aid roller 54 moves leftward from the polishing roller 51. The spring 57 causes the polishing aid roller 54 to exert tension to the inner circumferential surface of the fixing belt 26 outward.

As illustrated in FIG. 15, when the polishing roller 51 contacts the fixing belt 26, as the cam 60 rotates, the polishing aid roller unit 5V pivots and the polishing aid roller 54 starts moving rightward toward the polishing roller 51. While the cam 60 rotates, the holder 58 separates from the cam 60. The spring 61 biases the polishing aid roller 54 rightward. The polishing aid roller 54 is brought into contact with the fixing belt 26 and pressed against the polishing roller 51 via the fixing belt 26 by the spring 61. The spring 57 causes the polishing aid roller 54 to exert tension to the inner circumferential surface of the fixing belt 26 outward.

As illustrated in FIG. 15, the spring 57 presses the polishing aid roller 54 against the polishing roller 51 via the fixing belt 26, forming the polishing nip PN between the polishing roller 51 and the fixing belt 26. Simultaneously, the fixing belt 26 is wound around a part of the circumferential face of the polishing roller 51, changing the rotation locus of the fixing belt 26.

The straight line L3 connecting the center (e.g., the axis) of the polishing roller 51 and the center (e.g., the axis) of the polishing aid roller 54 and the straight line L2 passing through the center of the polishing roller 51 and being perpendicular to the outer circumferential surface of the fixing belt 26 form the angle θ (e.g., a wound angle). The fixing belt 26 is wound around the polishing roller 51 in the wound span defined by the angle θ. In an example illustrated in FIG. 15, the angle θ is 30 degrees.

The spring 61 presses the polishing aid roller 54 against the polishing roller 51 via the fixing belt 26. Accordingly, the polishing nip PN formed between the fixing belt 26 and the polishing roller 51 has a length of 1.8 mm in the rotation direction D26 of the fixing belt 26 with the angle θ of 30 degrees.

The driver 6 drives and rotates the polishing roller 51 through the gear mounted on at least one lateral end of the polishing roller 51 in the axial direction thereof such that the polishing roller 51 slides over the fixing belt 26 rotating in the rotation direction D26 with the predetermined circumferential velocity difference. Thus, the polishing roller 51 polishes the fixing belt 26. According to this embodiment, the polishing roller 51 slides over the fixing belt 26 in the forward direction at the linear velocity of the polishing roller 51 that is three times as fast as the surface linear velocity of the fixing belt 26. However, the linear velocity of the polishing roller 51 is not limited to the above.

With the construction of the fixing device 25V depicted in FIGS. 14 and 15, the fixing belt 26 contacts and presses against the polishing roller 51 evenly. Additionally, the polishing roller 51 contacts the fixing belt 26 in a sufficient contact area, decreasing a polishing time taken to restore the outer circumferential surface of the fixing belt 26.

Figure 16:
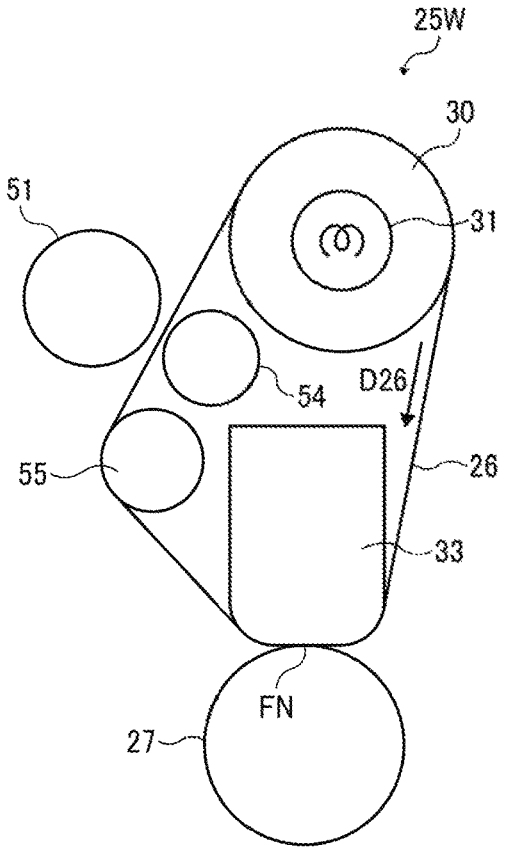
FIG. 16 is a vertical cross-sectional view of a fixing device being installable in the image forming apparatus depicted in FIG. 1 and incorporating a presser.

The following describes examples of the specification of the components incorporated in the fixing devices 25, 25S, 25T, 25U, and 25V according to the embodiments described above. FIGS. 2, 3, 6, 7, and 10 to 15 illustrate the fixing devices 25S, 25, 25T, 25U, and 25V each of which includes the fixing belt 26 that is looped over two rollers, that is, the fixing roller 29 and the heating roller 30, and heated by the heater 31 disposed inside one of the two rollers (e.g., the heating roller 30). Alternatively, for example, instead of the fixing roller 29, a presser 33 (e.g., a pressure pad) that is stationary and is not rotatable may be employed as illustrated in FIG. 16. FIG. 16 is a vertical cross-sectional view of a fixing device 25W incorporating the presser 33. As illustrated in FIG. 16, the fixing belt 26 is stretched taut across the presser 33 and the heating roller 30. The heater 31 may be a halogen heater or an induction heater (IH) using electromagnetic induction.

For example, the fixing belt 26 is a multi-layer endless belt constructed of a base layer, an elastic layer coating the base layer, and a release layer coating the elastic layer. The base layer, having a layer thickness of about 90 micrometers, is made of polyimide (Pt) resin. The elastic layer is made of silicone rubber or the like.

The elastic layer, having a layer thickness of about 200 micrometers, for example, is made of an elastic material such as silicone rubber, fluoro rubber, and silicone rubber foam.

The release layer, having a layer thickness of about 20 micrometers, for example, is made of tetrafluoroethylene-perfluoroalkylvinylether copolymer (PFA), polyimide (PI), polyether imide (PEI), polyether sulfide (PES), or the like. The release layer serving as a surface layer of the fixing belt 26 facilitates separation or peeling-off of toner of a toner image on a sheet serving as a recording medium from the fixing belt 26. The release layer fixes the toner image on the sheet properly and separates the sheet from the fixing belt 26 precisely.

Figure 17A:
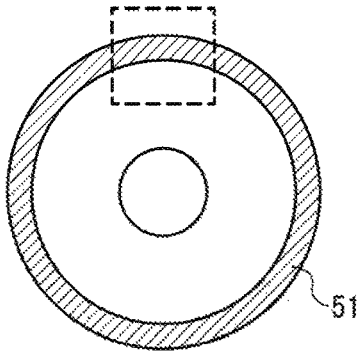
FIG. 17A is a vertical cross-sectional view of the polishing roller incorporated in the fixing device depicted in FIG. 2.

FIG. 17A is a vertical cross-sectional view of the polishing roller 51 serving as a slider that slides over the fixing belt 26. Since the polishing roller 51 is pressed against the fixing belt 26 with predetermined pressure, the polishing roller 51 rotates forward and backward to the rotation direction D26 of the fixing belt 26 with a linear velocity difference.

Figure 17B:
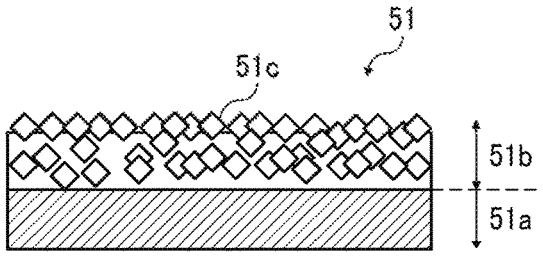
FIG. 17B is a partially enlarged horizontal cross-sectional view of the polishing roller depicted in FIG. 17A.

FIG. 17B is a partially enlarged horizontal cross-sectional view of the polishing roller 51. As illustrated in FIG. 17B, the polishing roller 51 includes a core bar 51*a* and a slide layer 51*b* disposed on the core bar 51*a*. The slide layer 51*b* serves as an abrasive grain layer or a polishing layer, for example. The slide layer 51*b* as a surface layer includes a binder resin and abrasive grains 51*c* dispersed in the binder resin. The abrasive grains 51*c* project beyond an outer circumferential surface of the slide layer 51*b* to define slight surface asperities. The abrasive grains 51*c* are alumina abrasive grains as general abrasive particles, for example, white fused alumina #1500. Alternatively, the abrasive grains 51*c* may be made of other materials. The grain size of the abrasive grains 51*c* may be identical throughout the entire slide span of the polishing roller 51 that slides over the fixing belt 26.

A description is provided of advantages of the fixing devices 25, 25S, 25T, 25U, 25V, and 25W.

As illustrated in FIGS. 2, 3, 6, 7, and 10 to 16, a fixing device (e.g., the fixing devices 25, 25S, 25T, 25U, 25V, and 25W) includes a fixing belt (e.g., the fixing belt 26), a pressure rotator (e.g., the pressure roller 27), a polishing roller (e.g., the polishing roller 51), and a polishing aid (e.g., the fixing roller 29 and the polishing aid roller 54).

The fixing belt is stretched taut across a plurality of supports (e.g., the fixing roller 29, the heating roller 30, and the polishing aid roller 54) and rotatable in a rotation direction (e.g., the rotation direction D26). The pressure rotator is pressed against the fixing belt to form a fixing nip (e.g., the fixing nip FN) therebetween. The polishing roller separably contacts the fixing belt. The polishing roller slides over an outer circumferential surface of the fixing belt while the polishing roller is pressed against the fixing belt. The polishing aid is at least one of the plurality of supports. The polishing aid is disposed opposite the polishing roller via the fixing belt. While the polishing roller is pressed against the fixing belt, the polishing roller is disposed opposite the polishing aid via the fixing belt to form a polishing nip (e.g., the polishing nip PN) between the polishing roller and the fixing belt. The polishing roller changes a rotation locus of the fixing belt along at least a part of a circumferential face (e.g., the slide layer 51*b*) of the polishing roller.

Accordingly, the polishing roller contacts and presses against the fixing belt evenly to polish the fixing belt in a sufficient contact area, shortening a polishing time when the polishing roller polishes the fixing belt.

According to the embodiments described above, the fixing belt 26 serves as a fixing belt. Alternatively, a fixing film, a fixing sleeve, or the like may be used as a fixing belt. Further, the pressure roller 27 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing belt rotatable in a rotation direction;

a pressure rotator pressed against the fixing belt to form a fixing nip between the fixing belt and the pressure rotator;

a polishing roller separably contacting the fixing belt, the polishing roller to slide over an outer circumferential surface of the fixing belt while the polishing roller is pressed against the fixing belt;

at least one support supporting and stretching the fixing belt; and a polishing aid, disposed opposite the polishing roller via the fixing belt, to support and stretch the fixing belt, the polishing roller being disposed opposite the polishing aid via the fixing belt to form a polishing nip between the polishing roller and the fixing belt while the polishing roller is pressed against the fixing belt, the polishing roller to change a rotation locus of the fixing belt along at least a part of a circumferential face of the polishing roller, and a contact area between the polishing roller and the fixing belt includes a first area that is the polishing nip and a second area that is not the polishing nip.

2. The fixing device according to claim 1, wherein the polishing aid includes a fixing roller to press against the pressure rotator via the fixing belt to form the fixing nip.

3. The fixing device according to claim 1, wherein the at least one support includes:

a fixing roller to press against the pressure rotator via the fixing belt to form the fixing nip; and a heating roller to heat the fixing belt.

4. The fixing device according to claim 1, wherein the at least one support includes:

a pressure pad to press against the pressure rotator via the fixing belt to form the fixing nip; and a heating roller to heat the fixing belt.

5. The fixing device according to claim 1, further comprising a presser to press the polishing aid against the polishing roller.

6. The fixing device according to claim 5, further comprising:

a holder including an elongate hole in which the polishing aid slides; and a cam, disposed opposite the polishing aid via the holder, to move the holder, wherein the presser includes a spring anchored to the holder and the polishing aid.

7. The fixing device according to claim 1, wherein the polishing aid exerts tension to the fixing belt.

8. The fixing device according to claim 1, wherein a straight line connecting a center of the polishing roller and a center of the polishing aid and a straight line passing through the center of the polishing roller and being perpendicular to the outer circumferential surface of the fixing belt form an angle 9.

9. The fixing device according to claim 8, wherein the angle θ formed when the polishing roller contacts the fixing belt is greater than the angle θ formed when the polishing roller is isolated from the fixing belt.

10. The fixing device according to claim 8, wherein the angle θ formed when the polishing roller contacts the fixing belt is not smaller than 10 degrees.

11. The fixing device according to claim 1, wherein at least one of the polishing roller and the polishing aid includes a surface layer made of an elastic body.

12. The fixing device according to claim 1, further comprising a driver to drive and rotate the polishing roller at a velocity different from a velocity of the fixing belt rotating in the rotation direction.

13. The fixing device according to claim 1, wherein the polishing aid includes a polishing aid roller.

14. The fixing device according to claim 1, wherein the polishing roller includes:

a core bar; and a slide layer being disposed on the core bar and including abrasive grains.

15. The fixing device according to claim 1, further comprising:

a holder holding the polishing roller; and a spring to press the polishing roller against the fixing belt.

16. The fixing device according to claim 1, further comprising another polishing aid, disposed opposite the polishing roller via the fixing belt, to support and stretch the fixing belt.

17. An image forming apparatus comprising:

an image forming device to form a toner image; and a fixing device disposed downstream from the image forming device in a recording medium conveyance direction to fix the toner image on a recording medium, the fixing device including:

a fixing belt rotatable in a rotation direction;

a pressure rotator pressed against the fixing belt to form a fixing nip between the fixing belt and the pressure rotator;

a polishing roller separably contacting the fixing belt, the polishing roller to slide over an outer circumferential surface of the fixing belt while the polishing roller is pressed against the fixing belt;

at least one support supporting and stretching the fixing belt; and a polishing aid, disposed opposite the polishing roller via the fixing belt, to support and stretch the fixing belt, the polishing roller being disposed opposite the polishing aid via the fixing belt to form a polishing nip between the polishing roller and the fixing belt while the polishing roller is pressed against the fixing belt, the polishing roller to change a rotation locus of the fixing belt along at least a part of a circumferential face of the polishing roller, and a contact area between the polishing roller and the fixing belt includes a first area that is the polishing nip and a second area that is not the polishing nip.

18. A fixing device comprising:

a fixing belt rotatable in a rotation direction;

a pressure rotator pressed against the fixing belt to form a fixing nip between the fixing belt and the pressure rotator;

a polishing roller separably contacting the fixing belt, the polishing roller to slide over an outer circumferential surface of the fixing belt while the polishing roller is pressed against the fixing belt;

at least one support supporting and stretching the fixing belt;

a polishing aid, disposed opposite the polishing roller via the fixing belt, to support and stretch the fixing belt;

a presser to press the polishing aid against the polishing roller;

a holder including an elongate hole in which the polishing aid slides; and a cam, disposed opposite the polishing aid via the holder, to move the holder, the polishing roller being disposed opposite the polishing aid via the fixing belt to form a polishing nip between the polishing roller and the fixing belt while the polishing roller is pressed against the fixing belt, the polishing roller to change a rotation locus of the fixing belt along at least a part of a circumferential face of the polishing roller, and the presser includes a spring anchored to the holder and the polishing aid.

19. A fixing device comprising:

a fixing belt rotatable in a rotation direction;

a pressure rotator pressed against the fixing belt to form a fixing nip between the fixing belt and the pressure rotator;

a polishing roller separably contacting the fixing belt, the polishing roller to slide over an outer circumferential surface of the fixing belt while the polishing roller is pressed against the fixing belt;

at least one support supporting and stretching the fixing belt; and a polishing aid, disposed opposite the polishing roller via the fixing belt, to support and stretch the fixing belt, the polishing roller being disposed opposite the polishing aid via the fixing belt to form a polishing nip between the polishing roller and the fixing belt while the polishing roller is pressed against the fixing belt, the polishing roller to change a rotation locus of the fixing belt along at least a part of a circumferential face of the polishing roller, a straight line connecting a center of the polishing roller and a center of the polishing aid and a straight line passing through the center of the polishing roller and being perpendicular to the outer circumferential surface of the fixing belt form an angle $\theta$, and the angle $\theta$ formed when the polishing roller contacts the fixing belt is greater than the angle $\theta$ formed when the polishing roller is isolated from the fixing belt.

* * * * *